US006446955B1

(12) United States Patent
Janatka et al.

(10) Patent No.: US 6,446,955 B1
(45) Date of Patent: Sep. 10, 2002

(54) METHOD AND APPARATUS FOR FEEDING ENVELOPES

(75) Inventors: Karel J. Janatka, Southbury, CT (US); John W. Sussmeier, Cold Spring, NY (US); William Wright, Killingworth, CT (US); James B. Andreyka, Monroe, CT (US); Boris Rozenfeld, New Milford, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/648,578

(22) Filed: Aug. 28, 2000

(51) Int. Cl.[7] ..... B65H 3/12

(52) U.S. Cl. ..... 271/96; 271/104; 271/106; 271/31.1

(58) Field of Search ..... 271/94, 96, 104, 271/106, 108, 30.1, 31.1, 11, 149

(56) References Cited

U.S. PATENT DOCUMENTS

| | | | | |
|---|---|---|---|---|
| 3,851,871 A | * | 12/1974 | Aronson | 271/11 |
| 4,260,146 A | * | 4/1981 | Mitzel | 271/94 |
| RE32,128 E | * | 4/1986 | Blümle | 271/94 |
| 4,739,982 A | * | 4/1988 | Hain | 271/94 |
| 4,789,148 A | * | 12/1988 | Noguchi et al. | 271/31.1 |
| 5,374,044 A | | 12/1994 | Belec et al. | 271/2 |
| 5,415,068 A | | 5/1995 | Marzullo et al. | 53/492 |
| 5,421,699 A | | 6/1995 | Guiles et al. | 414/788 |
| 5,447,015 A | | 9/1995 | Belec et al. | 53/492 |
| 6,095,513 A | * | 8/2000 | Wright et al. | 271/94 |

FOREIGN PATENT DOCUMENTS

| | | | | |
|---|---|---|---|---|
| JP | 403079525 A | * | 4/1991 | 271/96 |

* cited by examiner

*Primary Examiner*—H. Grant Skaggs
(74) *Attorney, Agent, or Firm*—Michael J. Cummings; Angelo N. Chaclas

(57) ABSTRACT

A method and apparatus for feeding envelopes in an envelope insertion machine, wherein a rotatable pneumatic feeding head is used to pick up an envelope from an envelope stack by a negative air pressure. The pneumatic feeding head is also used to move the envelope to a pair of take away rollers so that the envelope picked up by the feeding head can be moved further away from the envelope stack. It is preferred that the feeding head includes an outer cylinder having a row of vacuum ports and an inner cylinder having a plurality of apertures for air passage operatively connected to a vacuum pump. The inner cylinder is independently rotatable relative to the outer cylinder so that the negative air pressure is provided to the vacuum ports when the apertures of the inner cylinder are aligned with the vacuum ports, and the negative air pressure is turned off from the vacuum parts when the apertures and the vacuum ports are out of alignment.

4 Claims, 6 Drawing Sheets

METHOD AND APPARATUS FOR FEEDING ENVELOPES

TECHNICAL FIELD

The present invention relates to an envelope supply device and, more particularly, to an envelope feeder in an envelope insertion machine.

BACKGROUND OF THE INVENTION

In a typical envelope insertion machine for mass mailing, there is a gathering section where the enclosure material is gathered before it is inserted into an envelope. This gathering section includes a gathering transport with pusher fingers rigidly attached to a conveying means and a plurality of enclosure feeders mounted above the transport. If the enclosure material contains many documents, these documents must be separately fed by an envelope supply device from different enclosure feeders. After all the released documents are gathered, they are put into a stack to be inserted into an envelope in an inserting station. Envelopes are separately fed to the inserting station, one at a time, and each envelope is placed on a platform with its flap flipped back all the way. At the same time, a vacuum suction device or mechanical fingers are used to keep the envelope on the platform while the throat of the envelope is pulled away to open the envelope.

Before envelopes are fed to the insertion station, they are usually supplied in a stack in a supply tray. Envelopes are then separated by an envelope feeder so that only one envelope is fed to the insertion station at a time. For that reason, an envelope feeder is also referred to as an envelope singulator. In a high-speed insertion machine, the feeder should be able to feed single envelopes at a rate of approximately 18,000#10 envelopes per hour. At this feeding rate, it is critical that only a single envelope at a time is picked up and delivered to the insertion station.

In the past, as in the envelope feeder disclosed in U.S. Pat. No. 5,415, 068 (Marzullo), envelopes are singulated by using a belt to transport the last envelope in a stack to move downstream. If one or more envelopes move along with the last envelope, it will be stopped by a mechanical retarder which provides a friction force against the moving envelope. In the envelope feeder disclosed in Marzullo, the envelopes are stacked vertically and the bottom of the stack is spring-loaded to allow envelopes to be separated from the top of the stack. This type of envelope feeder requires adjustments to be made to the feeder or the transport and flapping section of the envelope processor system when envelopes of a different size is singulated. Furthermore, although the top separation design can eliminate some of the problems traditionally associated with pack pressure on units that rely on gravity to deliver the envelopes toward the separating device, envelope restocking is quite inconvenient.

SUMMARY OF THE INVENTION

The present invention provides a method and apparatus for feeding envelopes in an envelope insertion machine.

According the first aspect of the present invention, the method for feeding envelopes from a stack of envelopes in an envelope supply device includes the steps of: positioning a rotatable pneumatic apparatus at a pickup point at the proximity of the downstream end of the envelope stack; creating a negative air pressure on the pneumatic apparatus so as to attach an outer-most envelope of the envelope stack at the downstream end to the pneumatic apparatus; rotating the pneumatic apparatus in order to move the attached envelope away from the pickup point; and releasing the attached envelope from the pneumatic apparatus.

Additionally, the method comprises the step of turning off the negative air pressure on the pneumatic apparatus so as to release the attached envelope from the pneumatic apparatus. However, it is preferable to use a strip-away plate to strip off the attached envelope from the pneumatic apparatus.

Preferably, the pneumatic apparatus includes an outer cylinder having one or more openings for air passage, and an inner cylinder having one or more apertures for air passage located between the outer cylinder and the negative air pressure creating mechanism. The inner cylinder can be rotated to a first position relative to the outer cylinder to allow the negative air pressure creating mechanism to be operatively connected to the openings in order to create the negative air pressure on the pneumatic apparatus. The inner cylinder can also be rotated to a second position relative to the outer cylinder for operatively disconnecting the negative air pressure creating mechanism from the openings in order to turn off the negative air pressure on the pneumatic apparatus.

The second aspect of the present invention is a pneumatic apparatus to be used in an envelope supply device to pick up one envelope at a time from a stack of envelopes at a pickup point, wherein the pneumatic apparatus is used in conjunction with a vacuum pump or any negative air pressure producing mechanism. The pneumatic apparatus includes: a rotatable feeding head having one or more openings for air passage; a rotating mechanism to rotate the feeding head in order to position the openings at the pickup point; a device for operatively connecting the openings to the vacuum pump for creating a negative air pressure at the openings in order to pick up and attach to the feeding head the outer-most envelope of the envelope stack at the downstream end; and a moving mechanism to move the attached envelope away from the pickup point in order to release the attached envelope from the feeding head. Preferably, the pneumatic apparatus also includes a device to turn off the negative air pressure at the openings when the feeding head is in the process of picking up an envelope.

The third aspect of the present invention is an envelope supply device for picking up envelopes from a stack of envelopes at a pickup point, wherein the envelope supply device is used in conjunction with a vacuum pump. The envelope supply device includes: a rotatable pneumatic feeding head operatively connected to the vacuum pump; a rotating mechanism to rotate the pneumatic feeding head to the pickup point in order to attach an outer-most envelope of the envelope stack to the pneumatic feeding head; and a movement device to move the attached envelope away from the pickup point in order to release the attached envelope from the feeding head. Preferably, the envelope stack is placed on a main deck having a lead edge deck which is substantially perpendicular to the surface of the main deck. The lead edge deck is used to justify the lead edge of the envelopes in the envelope stack. Preferably, the main deck is tilted in an angle so that the gravity will help pull the lead edge of envelopes toward the lead edge deck. The envelope supply device further includes a pusher back paddle placed behind the envelope stack to constantly push the stack toward the downstream end of the envelope supply device.

The present invention will become apparent upon reading the descriptions taken in conjunction with FIGS. 1–4E.

DETAILED DESCRIPTION

Figure 1:
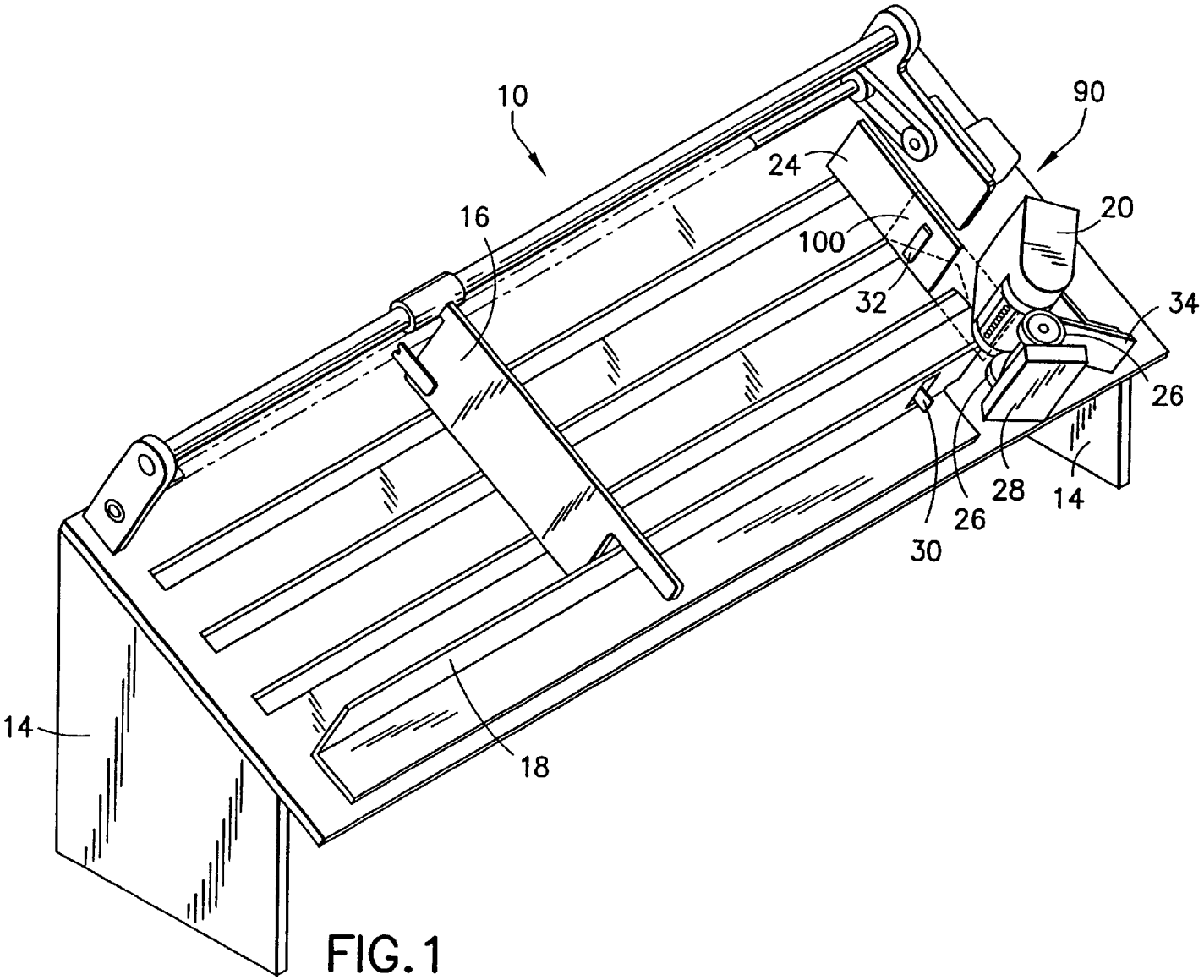
FIG. 1 is an isometric view showing the envelope supply device according to the present invention.

FIG. 1 illustrates an isometric view of an envelope supply device 10, which is a part of an envelope insertion machine (not shown). As shown in FIG. 1, the envelope supply device 10 includes a feed tray, or main deck 12, a pair of deck supports 14, a pusher back paddle 16, a lead edge deck 18 and a pneumatic feeding head 20. The pneumatic feeding head 20 is located at one corner of the downstream end 90 of the envelope supply device 10. Envelopes are stacked into a stack (not shown) between the pneumatic apparatus 20 and the pusher back paddle 16. The envelope stack is constantly pushed by the pusher back paddle 16 toward the downstream end 90 so that the envelope supply device 10 will have an adequate supply of envelopes for feeding. One of the envelopes is shown in dashed lines and denoted by numeral 100. Each envelope of the stack is vertically oriented, with one of the long edges touching the main deck surface, and one of the side edges aligned against the lead edge deck 18, which is substantially perpendicular to the surface of the main deck 12. The side edge that is aligned against the lead edge deck 18 is referred to as the lead edge of the envelope. It is preferred that the envelopes are stacked upside down with the crease line (top long edge) touching the deck surface, and the flap closed and facing the pusher back paddle 16. It is also preferred that the main deck 12 is tilted at an angle $\alpha$ from the horizontal plane such that the long edges of the envelopes are also substantially tilted at the same angle $\alpha$ from the horizontal plane. The tilt angle $\alpha$ can range from 5 to 45 degrees, but, preferably, about 30 degrees. With the main deck 12 being tilted at an angle, the envelopes in the stack are pulled towards the lead edge deck 18 by gravity. As such, all the envelopes are justified at the lead edge regardless of the envelope size. Thus, the tilting of the main deck substantially eliminates the requirement to adjust the envelope supply device 10 in order to accommodate envelopes of different sizes. At the downstream end 90 of the main deck 12, a stop fence 24 is used to stop the approaching envelopes. As described later in conjunction with FIGS. 2 and 4A–4E, the pneumatic apparatus 20 uses a negative air pressure to pick up or retrieve the envelopes 100, one at the time, from the envelope stack. After picking up the envelope, the pneumatic apparatus 20 is rotated toward a pair of take-away rollers 26 so that the envelope picked up by the pneumatic apparatus 20 can be moved away from the pneumatic apparatus 20 and the envelope stack. As shown, the take-away rollers 26 are mounted on a roller mount 28. Also shown in FIG. 1 is a separator plate 30, movably mounted on the lead edge deck 18. The separator plate 30 is used to adjust the gap between the envelope stack and the pneumatic apparatus 20, as shown in FIGS. 4A–4E, to prevent more than one envelope from being taken away at a time from the envelope stack by the pneumatic apparatus 20 and the take-away rollers 26. It is also preferred that a strip-away plate 34 is used to strip the retrieved envelope from the pneumatic apparatus 20, as shown in FIG. 4E. As shown in FIG. 1, an envelope sensor 32 located on the stop fence 24 is used to alert an operator when the envelope supply is low or depleted.

Figure 2:
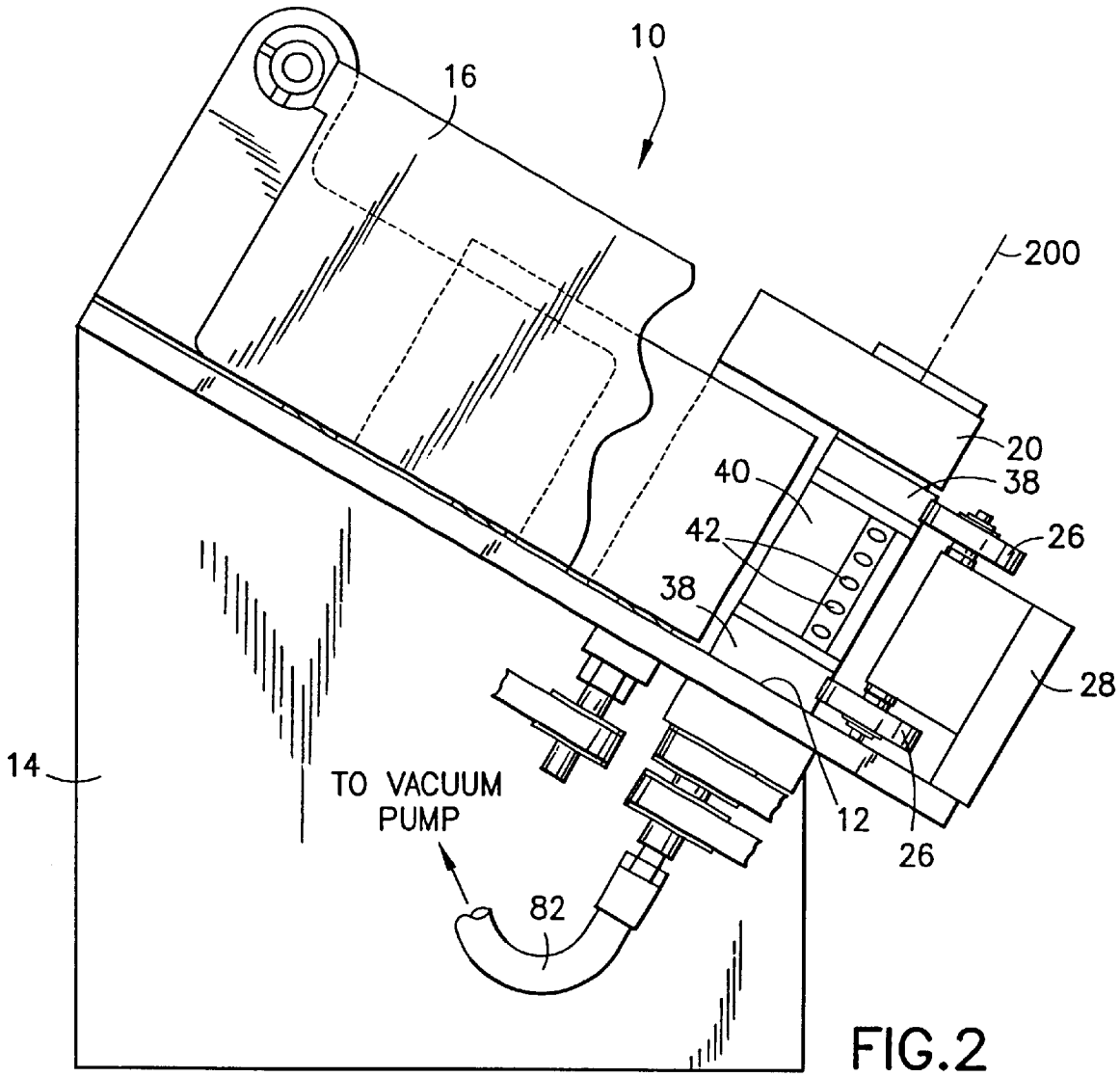
FIG. 2 is an isometric view showing the pneumatic feeding head.

FIG. 2 illustrates an isometric view of pneumatic apparatus 20. As shown, the pneumatic apparatus 20 includes a feeding head 40 which can be rotated about an axis 200 which is substantially perpendicular to the surface of the main deck 12. On the feeding head 50, a row of vacuum ports 42 are used to provide the suction force necessary to pick up the lead edge of an envelope 100, as shown in FIGS. 4B and 4C. The suction force is produced by pumping air out of the feeding head 40 through an air conduit 82 thereby creating a vacuum or a negative air pressure at the vacuum ports 42. It is understood that air is pumped out by a vacuum pump which is well known and, therefore, is not shown in FIG. 2. When the feeding head 40 is rotated such that the vacuum ports 42 are located near the envelope stack 102 (FIGS. 4A–4E), the negative air pressure at the vacuum ports 42 draw the lead edge of the outer-most envelope 100 of the envelope stack 102 towards the vacuum ports 42, causing the envelope to become attached to the feeding head 40, as shown in FIG. 4B. As the feeding head 40 continues to rotate, as shown in FIGS. 4C and 4D, it moves the attached envelope 100 toward the take-away rollers 26 so as to allow the take-away rollers 26 to move the envelope 100 away from the pickup point 50. The attached envelope 100 is then stripped off from the feeding head 40 by a strip-away plate 34 and the envelope is moved further away by the take-away rollers 26. Also shown in FIG. 2 are a pair of inner rollers 38, each of which is used to form a take-away nip with a respective take-away rollers 26.

Figure 3:
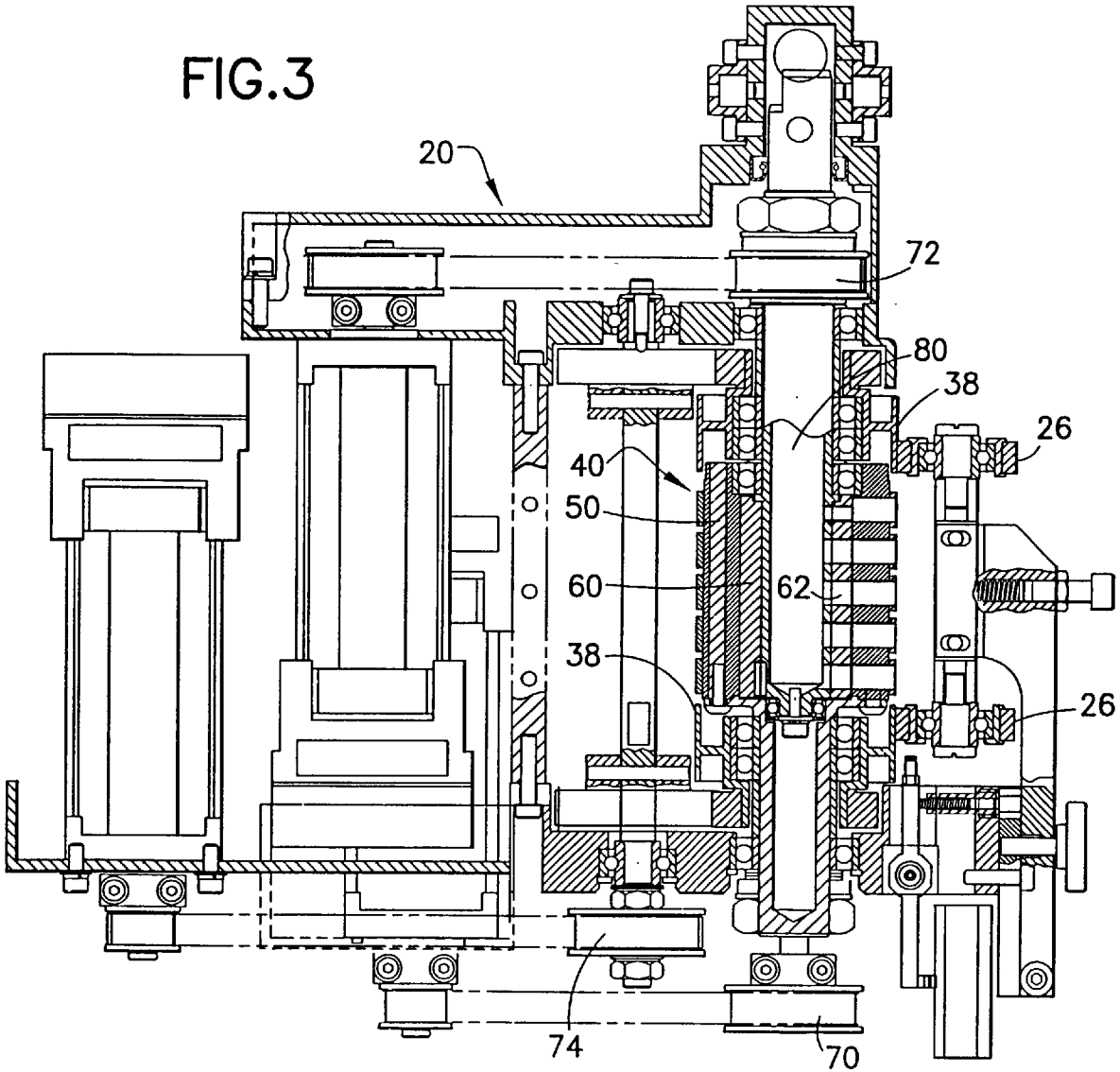
FIG. 3 illustrates a cross sectional view of the pneumatic feeding head.

It is preferred, however, that the feeding head 40 comprises an outer cylinder 50 and an inner cylinder 60 which can be rotated independently of each other, as shown in FIGS. 4A through 4E. The outer cylinder 50 is used for placing thereon the vacuum ports 42. As shown in FIG. 3, the inner cylinder 60 includes a plurality of apertures 62 similar to the vacuum ports 42 of the outer cylinder 50. As air is pumped out from the inner core 80 of the feeding head 40 via the apertures 62 and the air conduit 82, a negative air pressure is provided to the vacuum ports 42 when the apertures 62 are aligned with the vacuum ports 42. Thus, when the inner cylinder 60 and the outer cylinder 50 are in an aligned position, the vacuum ports 42 are operatively connected to the vacuum pump. However, when the inner cylinder 60 and the outer cylinder 50 are completely out of the aligned position, the negative air pressure is not provided to the vacuum ports 42 through the apertures 62. In this respect, the inner cylinder 62 is used as an air valve which can turn on or off the negative air pressure at the vacuum ports 42. Thus, when the inner cylinder 60 and the outer cylinder 50 are not in the aligned position, the vacuum ports 42 are operatively disconnected from the vacuum pump.

Also shown in FIG. 3 are a plurality of movement devices: pulley 70 is used to rotate the outer cylinder 50; pulley 72 is used to rotate the inner cylinder 60; and pulley 74 is used to drive the inner rollers 38 and take-away rollers 26.

Figure 4A:
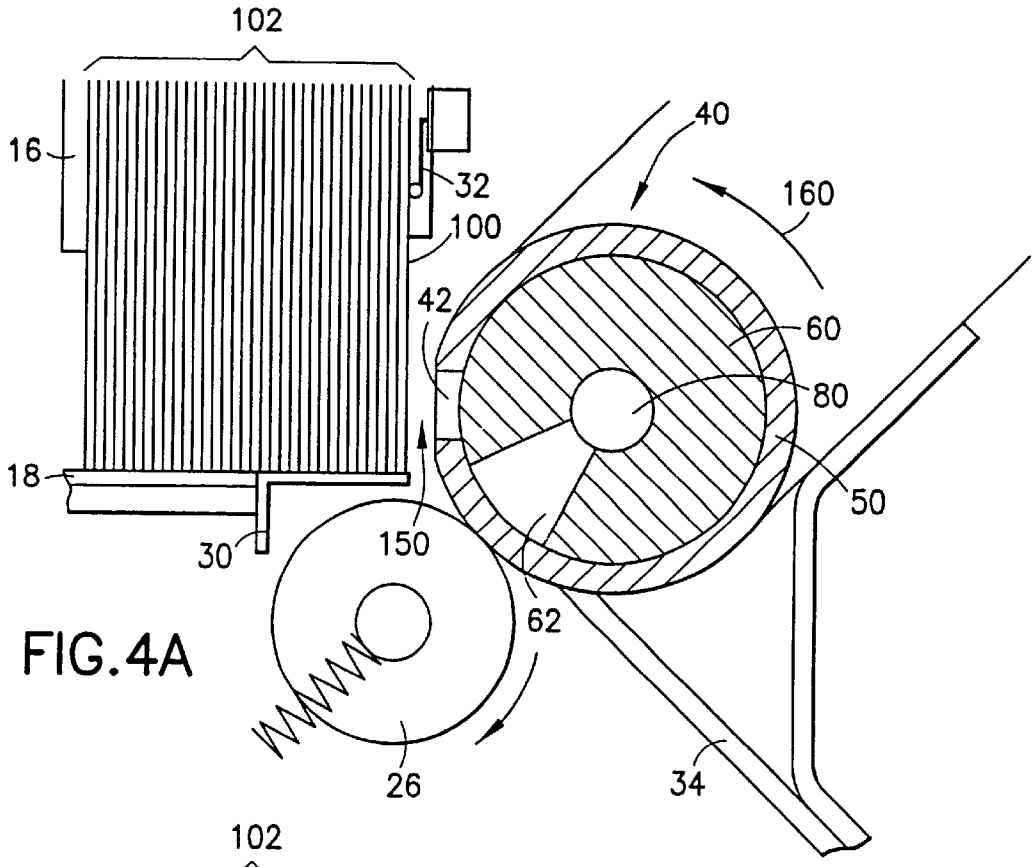
FIG. 4A through FIG. 4E illustrate the principle of the envelope supply device.
Figure 4B:
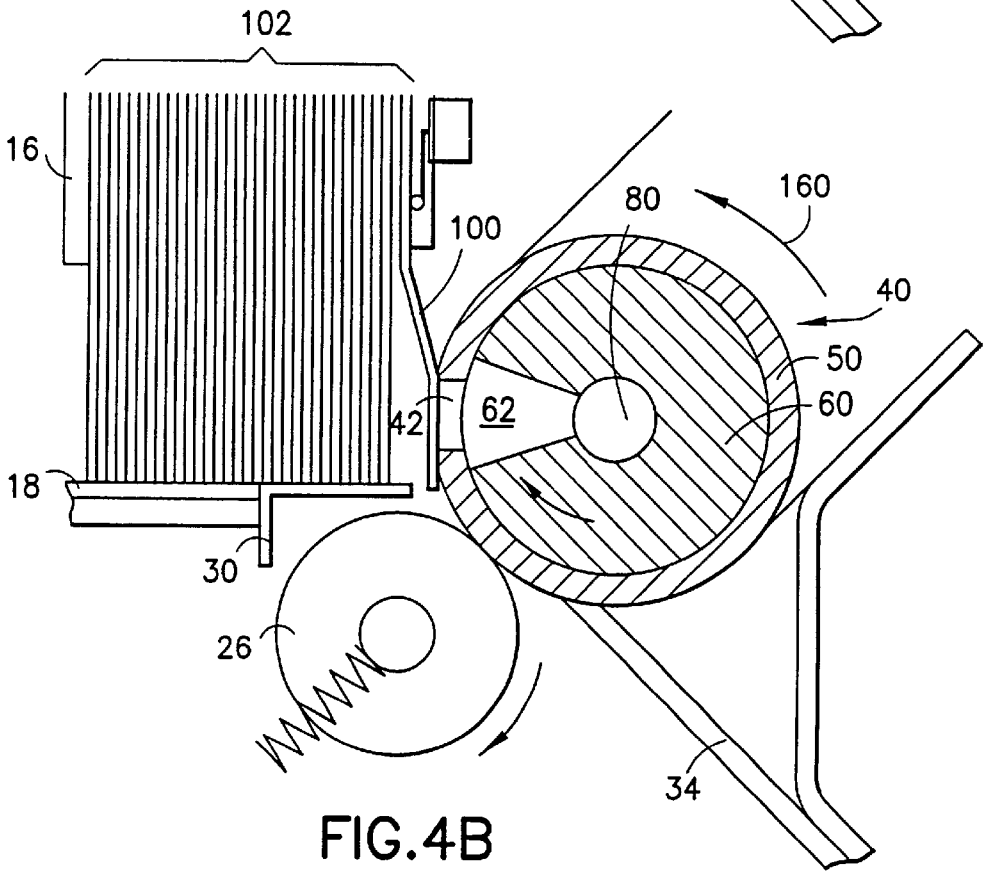
Figure 4C:
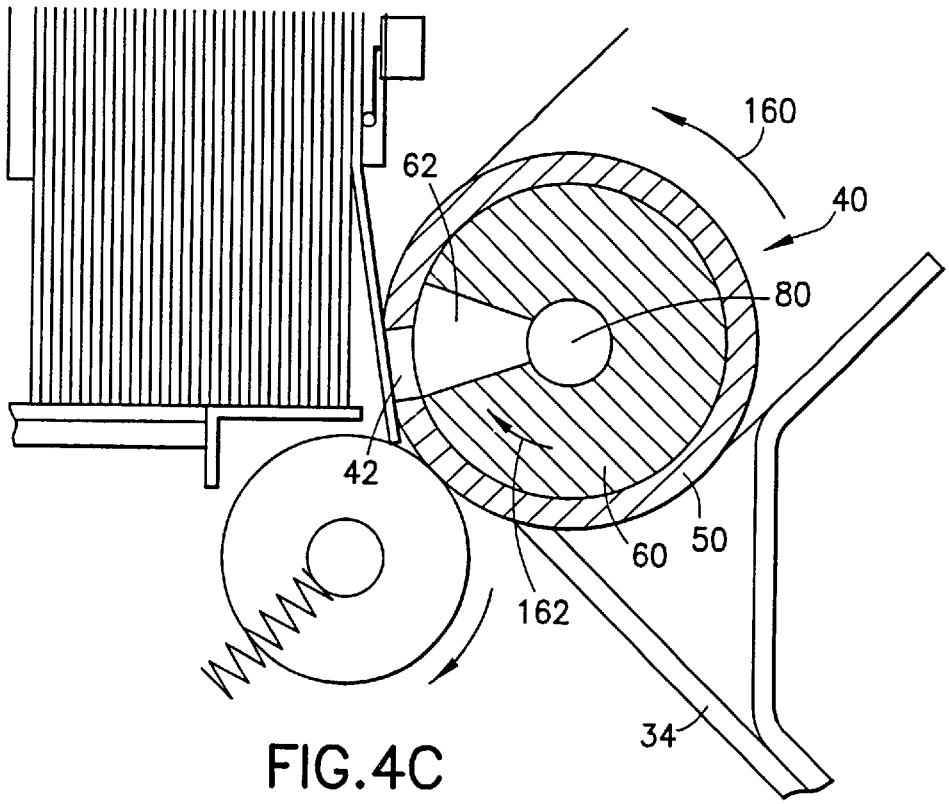
Figure 4D:
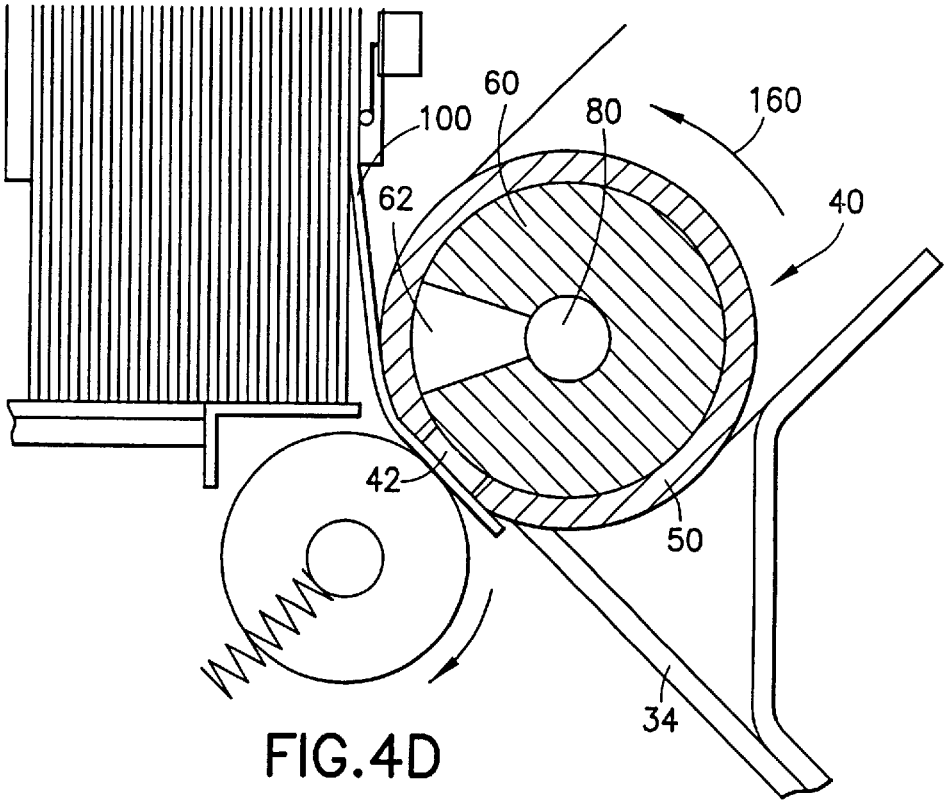
Figure 4E:
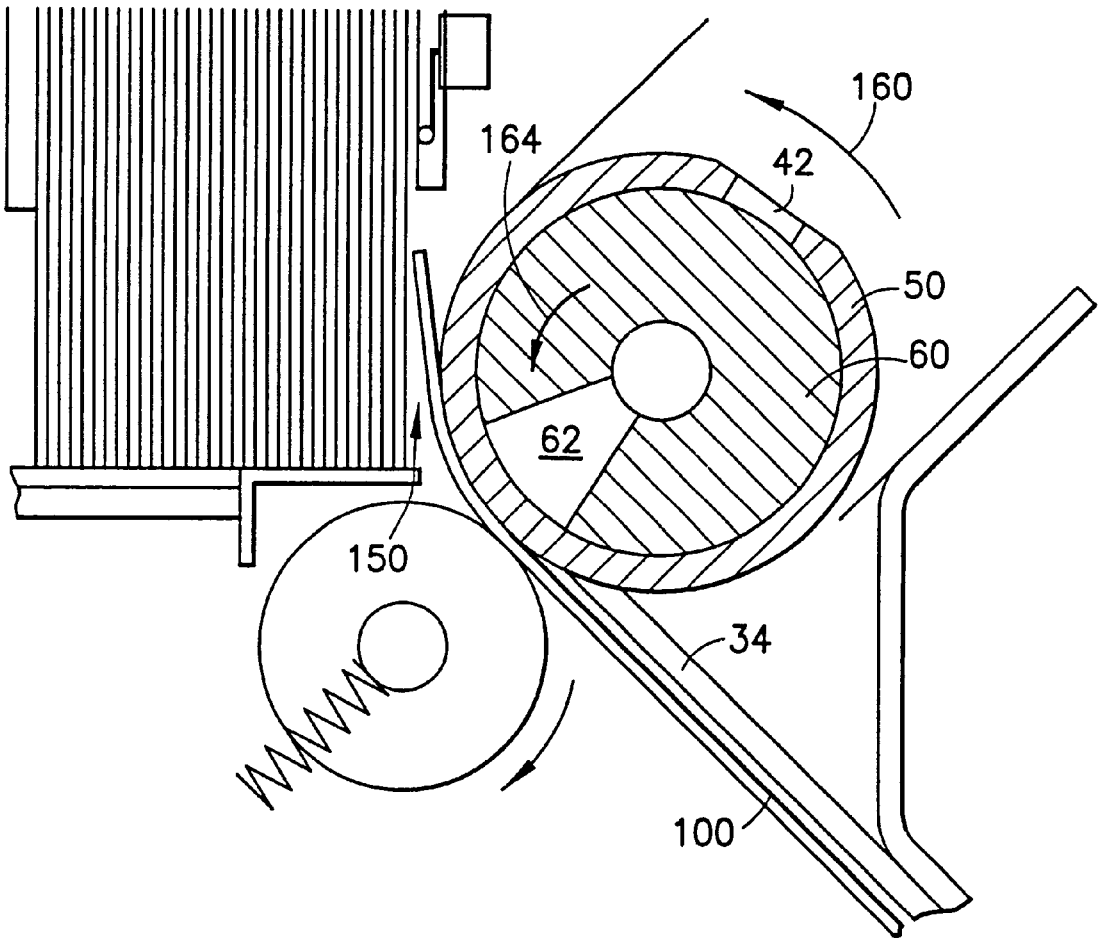

FIGS. 4A through 4B illustrate the principle of envelope feeding using the feeding head 40 which has an inner cylinder 60 and an outer cylinder 50. As shown in FIG. 4A, while the vacuum ports 42 of the outer cylinder 50 is positioned at the pickup point 150, the apertures 62 of the inner cylinder 60 are not aligned with the vacuum ports 42. Thus, the vacuum ports 42 are operatively disconnected from the vacuum pump, and the feeding head 40 has no effects on the outer-most envelope 100 of the envelope stack 102.

When the inner cylinder 60 is rotated relative to the outer cylinder 50 such that the apertures 62 of the inner cylinder 60 are aligned with the vacuum ports 42 of the outer cylinder 50, the vacuum ports 42 are operatively connected to the vacuum pump. The negative air pressure at the vacuum ports 42 draws the lead edge of the envelope 100 towards the feeding head 40 and causes the envelope 100 to become attached to the feeding head 40, as shown in FIG. 4B.

As shown in FIG. 4C, the outer cylinder 50 continues to rotate in a counter-clockwise direction, as indicated by arrow 160, in order to bring the attached envelope 100 into contact with the take-away rollers 26. At the same time, the inner cylinder 60 is rotated in a clockwise direction so as to turn off the negative air pressure at the vacuum port 42. As soon as the envelope 100 picked up by the feeding head 40 is taken away by the take-away rollers 26, the negative air pressure at the vacuum ports 42 is no longer needed. Thus, it is preferred that as soon as the envelope 100 picked up by the feeding head 40 is taken over by the take-away rollers 26, the apertures 62 of the inner cylinder 60 and the vacuum ports 42 of the outer cylinder 50 are out of alignment, as shown in FIG. 4D. The vacuum ports 42 are now operatively disconnected from the vacuum pump so as to allow the vacuum in the inner core 80 and the air conduit 82 to be properly re-established.

As shown in FIG. 4E, the envelope 100 picked up by the feeding head 40 is stripped away from the feeding head 40 by a strip-away plate 34, effectively releasing the envelope 100 from the feeding head 40. As the outer cylinder 50 continues to move in the counter-clockwise direction 160 in order to position the vacuum ports 42 at the pickup point 150, the inner cylinder 60 is rotated along the same direction, as indicated by arrow 164, so as to keep the apertures 62 away from the pickup point 150. The envelope feeding cycle repeats itself as the feeding head 40 comes back to the position shown in FIG. 4A.

Thus, the present invention has been disclosed in the preferred embodiment thereof. It should be understood by those skilled in the art that the foregoing and various other changes, omissions and deviations in the form and detail thereof may be made without departing from the spirit and the scope of this invention. For example, as illustrated in FIGS. 4A–4C, the outer cylinder 50 is rotated along one direction as indicated by the arrow 160, while the inner cylinder 60 is engaged in an oscillation like motion. However, it is also possible that the inner cylinder 60 is rotated only in the counter-clockwise direction, along with the outer cylinder 50, but with a different velocity. Furthermore, the rotation velocity of the outer cylinder 50 can be uniform or non-uniform. Also, the outer cylinder can also be caused to make an oscillating motion if so desired. The take-away rollers can be controlled, for example, by an electronic processor in order to accommodate envelopes of different sizes and feed speed. The movement of the vacuum drum can have different actuation profiles by means of software. For example, through software, the movement of the inner cylinder 60 can be altered from a rotary (360 degree) motion to an oscillating motion quickly and easily if required. Furthermore, the outer cylinder 50 can be accelerated, decelerated or paused during a feeding cycle in order to optimize throughput.

What is claimed is:

1. A method for feeding envelopes from a stack of envelopes in an envelope supply device, the envelope supply device having a vacuum source, the envelope supply device also having a rotatable pneumatic apparatus located at a downstream end of the stack of envelopes, the rotatable pneumatic apparatus comprising a rotatable outer cylinder having an envelope contact surface and an outer vacuum opening in the envelope contact surface, and a rotatable inner cylinder having an aperture connected to the vacuum source, the outer cylinder and inner cylinder being rotatable at different angular velocities with respect to each other about a common cylinder axis, the inner cylinder having a first rotational position relative to the outer cylinder whereby the aperture of the inner cylinder is aligned with the outer vacuum opening of the outer cylinder, the inner cylinder having a second position relative to the outer cylinder whereby the aperture is not aligned with the outer vacuum opening, said method comprising the steps of:

rotating the outer cylinder so that the outer vacuum opening is proximal to an end-most envelope at the downstream end of the envelope stack;

rotating the inner cylinder in the opposite direction as the outer cylinder such that it is in the first position relative to the outer cylinder when the outer cylinder is proximal to the end-most envelope, thereby connecting the vacuum source to the outer vacuum opening and creating a sudden negative air pressure on the end-most envelope, drawing the end-most envelope against the envelope contact surface of the outer cylinder;

rotating the outer cylinder to move the end-most envelope away from the downstream end of the envelope stack;

releasing the negative air pressure on the end-most envelope from the outer vacuum opening of the outer cylinder by maintaining the inner cylinder substantially stationary while the outer cylinder continues to rotate, whereby the inner cylinder is at the second position relative to the outer cylinder and the vacuum source disconnects from the outer vacuum opening; and subsequently rotating the inner cylinder in the same direction as the outer cylinder to reset the inner cylinder in order to repeat the step of rotating the inner cylinder in the opposite direction as the outer cylinder.

2. The method of claim 1 wherein the step of releasing the negative air pressure comprises rotating the inner cylinder relative to the outer cylinder so that the inner cylinder is in the second position.

3. The method of claim 1, further comprising the step of stripping off the end-most envelope from the envelope contact surface of the outer surface by a stripping device to assist releasing the attached envelope from the pneumatic apparatus.

4. The method of claim 1, further comprising the step of biasing the envelope stack toward the downstream end in order to position the end-most envelope proximal to the pneumatic apparatus.

* * * * *